US010549875B2

(12) United States Patent
Spivey, Sr. et al.

(10) Patent No.: US 10,549,875 B2
(45) Date of Patent: Feb. 4, 2020

(54) CARTON WITH HANDLE

(71) Applicant: Graphic Packaging International, LLC, Atlanta, GA (US)

(72) Inventors: Raymond R. Spivey, Sr., Mableton, GA (US); Charles Frances Coxe, Jr., Hiawassee, GA (US); Aaron Lee Bates, Kennesaw, GA (US); Mark Baldino, Marietta, GA (US)

(73) Assignee: Graphic Packaging International, LLC, Atlanta, GA (US)

( * ) Notice: Subject to any disclaimer, the term of this patent is extended or adjusted under 35 U.S.C. 154(b) by 771 days.

(21) Appl. No.: 14/926,422

(22) Filed: Oct. 29, 2015

(65) Prior Publication Data

US 2016/0122074 A1 May 5, 2016

Related U.S. Application Data

(60) Provisional application No. 62/122,816, filed on Oct. 30, 2014.

(51) Int. Cl.
*B65D 5/42* (2006.01)
*B65D 5/462* (2006.01)
(Continued)

(52) U.S. Cl.
CPC ..... *B65B 61/14* (2013.01); *B65D 5/46* (2013.01); *B65D 5/4608* (2013.01); *B65D 5/46072* (2013.01)

(58) Field of Classification Search
CPC ..... B65D 5/4608; B65D 5/46096; B65D 5/46075; B65D 5/46072; B65D 5/46088;
(Continued)

(56) References Cited

U.S. PATENT DOCUMENTS 1,253,193 A 1/1918 Hill
1,925,102 A 9/1933 Levkoff
(Continued)

FOREIGN PATENT DOCUMENTS

CA 740309 8/1966
CA 873185 6/1971
(Continued)

OTHER PUBLICATIONS

International Search Report and Written Opinion for PCT/US2015/057986 dated Jan. 26, 2016.
(Continued)

*Primary Examiner* — Nathan J Newhouse
*Assistant Examiner* — Nina K Attel
(74) *Attorney, Agent, or Firm* — Womble Bond Dickinson (US) LLP

(57) ABSTRACT

A carton for holding a plurality of containers. The carton includes a plurality of panels that extends at least partially around an interior of the carton. The carton includes a first end flap foldably connected to a first panel of the plurality of panels and a second end flap foldably connected to a second panel of the plurality of panels. The first end flap and the second end flap form a closed end of the carton. The carton further includes a handle comprising a first handle feature in the first end flap and a second handle feature in the second end flap. The first and second handle features are configured for directing stress and controlling tearing of the carton when force is applied to the handle.

39 Claims, 5 Drawing Sheets

(51) Int. Cl.
*B65D 5/468* (2006.01)
*B65B 61/14* (2006.01)
*B65D 5/46* (2006.01)

(58) Field of Classification Search
CPC ..... B65D 5/4612; B65D 5/46128; B65D 5/46152; B65D 5/4616
USPC ..... 229/117.16, 117.13, 117.14, 117.15, 229/117.17, 117.09, 117.12
See application file for complete search history.

(56) References Cited

U.S. PATENT DOCUMENTS 2,005,924 A 6/1935 Wilson
2,067,749 A 1/1937 Zimmerman et al.
2,115,673 A 4/1938 Stompe
2,196,502 A 4/1940 Kells
2,216,299 A 10/1940 Schilling
2,297,284 A 9/1942 Blackman
2,299,027 A 10/1942 Novak
2,383,183 A 8/1945 Fishcher
2,386,905 A 10/1945 Meitzen
2,594,376 A 4/1952 Arneson
2,613,867 A 10/1952 Darr
2,648,484 A 8/1953 Belsinger
2,669,351 A 2/1954 Carson et al.
2,702,144 A 2/1955 Forrer
2,754,047 A 7/1956 Schmidt et al.
2,785,847 A 3/1957 Forrer
2,797,856 A 7/1957 Jaeschke
2,810,506 A 10/1957 Kessler
2,868,433 A 1/1959 Anderson, Jr.
2,955,739 A 10/1960 Collura
2,986,324 A 5/1961 Anderson, Jr.
3,078,032 A 2/1963 Robinson et al.
3,112,856 A 12/1963 MacIntosh et al.
3,127,720 A 4/1964 Gentry et al.
3,128,010 A 4/1964 Forrer
3,133,634 A 5/1964 Bozdar
3,173,596 A 3/1965 Aust et al.
3,178,242 A 4/1965 Ellis et al.
3,204,815 A 9/1965 Weis
3,228,582 A 1/1966 Osberg
3,263,861 A 8/1966 Carr
3,265,283 A 8/1966 Farquhar
3,300,115 A 1/1967 Schauer
3,309,005 A 3/1967 Pilger
3,332,594 A 7/1967 De Capua
3,334,767 A 8/1967 Cornelius et al.
3,346,167 A 10/1967 Schmidt
3,355,012 A 11/1967 Weiss
3,356,279 A 12/1967 Root
3,371,846 A 3/1968 Detzel
3,381,881 A 5/1968 Granz et al.
3,410,476 A 11/1968 Buttery
3,517,858 A 6/1970 Farquhar
3,533,549 A 10/1970 Gilchrist
3,540,581 A 11/1970 Koolnis
3,744,709 A 7/1973 Akkerman
3,788,538 A 1/1974 Kuenzi
3,825,170 A 7/1974 Aust et al.
3,828,926 A 8/1974 Rossi
3,886,901 A 6/1975 Zeitter
3,894,681 A 7/1975 Arneson et al.
3,904,036 A 9/1975 Forrer
3,933,303 A 1/1976 Kirby, Jr.
3,951,332 A 4/1976 Torbeck
3,994,432 A 11/1976 Kirby, Jr.
4,029,204 A 6/1977 Manizza
4,036,423 A 7/1977 Gordon
4,096,985 A 6/1978 Wood
4,109,849 A 8/1978 Wood
4,111,306 A 9/1978 Roccaforte
4,155,449 A 5/1979 Bryne
4,195,765 A 4/1980 Roccaforte et al.
4,214,660 A 7/1980 Hunt, Jr.
4,216,861 A 8/1980 Oliff
4,222,485 A 9/1980 Focke
4,256,226 A 3/1981 Stone
4,318,474 A 3/1982 Hasegawa
4,328,923 A 5/1982 Graser
4,331,289 A 5/1982 Killy
4,364,509 A 12/1982 Holley, Jr. et al.
4,375,258 A 3/1983 Crayne et al.
4,376,509 A 3/1983 Schaffer
4,378,877 A 4/1983 Botterman et al.
4,378,905 A 4/1983 Roccaforte
4,382,505 A 5/1983 Sutherland et al.
4,396,143 A 8/1983 Killy
4,417,655 A 11/1983 Forbes, Jr.
4,417,661 A 11/1983 Roccaforte
4,418,864 A 12/1983 Nielsen
4,424,901 A 1/1984 Lanier
4,436,244 A 3/1984 Morris
4,440,340 A 4/1984 Bakx
4,478,334 A 10/1984 Graser
4,498,619 A 2/1985 Roccaforte
4,508,258 A 4/1985 Graser
4,531,668 A 7/1985 Forbes, Jr.
4,538,759 A 9/1985 Dutcher
4,545,485 A 10/1985 Oliff
4,546,914 A 10/1985 Roccaforte
4,577,762 A 3/1986 Kuchenbecker
4,577,799 A 3/1986 Oliff
4,588,084 A 5/1986 Holley, Jr.
4,605,128 A 8/1986 Rieke
4,621,766 A 11/1986 McClure
4,653,686 A 3/1987 Wood et al.
4,658,984 A 4/1987 Brunner
4,706,876 A 11/1987 Wilson
4,712,728 A 12/1987 Schuster
4,717,070 A 1/1988 Taub
4,718,597 A 1/1988 Bishop
4,747,487 A 5/1988 Wood
4,757,938 A 7/1988 Collins
4,784,266 A 11/1988 Chaussadas
4,784,316 A 11/1988 Crouch
4,802,583 A 2/1989 Calvert et al.
4,816,014 A 3/1989 Bratton et al.
4,817,866 A 4/1989 Wonnacott
4,830,267 A 5/1989 Wilson
4,875,586 A 10/1989 Chaussadas
4,890,440 A 1/1990 Romagnoli
4,949,845 A 8/1990 Dixon
4,966,324 A 10/1990 Steel
4,967,901 A 11/1990 Wood
4,974,771 A 12/1990 Lavery
5,020,337 A 6/1991 Krieg
5,060,792 A 10/1991 Oliff
5,072,876 A 12/1991 Wilson
5,094,359 A 3/1992 DeMars et al.
5,101,642 A 4/1992 Alexandrov
5,106,014 A 4/1992 Miller
5,119,985 A 6/1992 Dawson et al.
5,137,211 A 8/1992 Summer et al.
5,197,598 A 3/1993 Stout et al.
5,219,229 A 6/1993 Sengewald
5,221,041 A 6/1993 Stout et al.
5,222,658 A 6/1993 DeMaio et al.
5,224,919 A 7/1993 Walsh
5,234,102 A 8/1993 Schuster et al.
5,246,112 A 9/1993 Stout et al.
5,249,681 A 10/1993 Miller
5,284,294 A 2/1994 Floyd
5,292,058 A 3/1994 Zoss et al.
5,297,725 A 3/1994 Sutherland
5,303,863 A 4/1994 Arasim
5,307,932 A 5/1994 Stout et al.
5,307,986 A 5/1994 Schuster
5,307,987 A 5/1994 Roccaforte
5,320,277 A 6/1994 Stout et al.
5,328,081 A 7/1994 Saulas
5,333,734 A 8/1994 Stout et al.
D350,480 S 9/1994 Sutherland

(56) References Cited

U.S. PATENT DOCUMENTS 5,350,062 A 9/1994 Takiguchi et al.
5,350,109 A 9/1994 Brown et al.
5,379,944 A 1/1995 Stout et al.
5,381,891 A 1/1995 Harris
5,385,234 A 1/1995 Stout et al.
5,392,984 A 2/1995 Yocum
5,395,044 A 3/1995 Stout
5,425,474 A 6/1995 Dalea et al.
5,427,241 A 6/1995 Sutherland
5,458,234 A 10/1995 Harris
5,472,090 A 12/1995 Sutherland
5,480,091 A 1/1996 Stout
5,482,185 A 1/1996 McNaughton
5,482,203 A 1/1996 Stout
5,485,915 A 1/1996 Harris
5,495,727 A 3/1996 Strong et al.
5,505,372 A 4/1996 Edson et al.
5,524,756 A 6/1996 Sutherland
5,551,556 A 9/1996 Sutherland
5,575,421 A 11/1996 Heo
5,577,612 A 11/1996 Chesson et al.
5,582,343 A 12/1996 Dalvey
5,588,585 A 12/1996 McClure
5,597,114 A 1/1997 Kramedjian et al.
5,622,309 A 4/1997 Matsuda et al.
5,639,017 A 6/1997 Fogle
5,647,483 A 7/1997 Harris
5,664,683 A 9/1997 Brody
5,669,500 A 9/1997 Sutherland
5,690,213 A 11/1997 Matsumura
5,690,230 A 11/1997 Griffith
5,699,957 A 12/1997 Bin et al.
5,704,470 A 1/1998 Sutherland
5,738,273 A 4/1998 Auclair
5,794,778 A 8/1998 Harris
5,826,782 A 10/1998 Stout
5,826,783 A 10/1998 Stout
5,873,515 A 2/1999 Dunn et al.
5,873,516 A 2/1999 Boggs
5,875,961 A 3/1999 Stone et al.
5,878,946 A 3/1999 Frerot et al.
5,881,884 A 3/1999 Podosek
5,906,313 A 5/1999 Oliff
5,915,546 A 6/1999 Harrelson
5,921,398 A 7/1999 Carroll
5,924,559 A 7/1999 Carrel et al.
5,927,498 A 7/1999 Saam
5,992,733 A 11/1999 Gomes
6,019,276 A 2/2000 Auclair
6,021,897 A 2/2000 Sutherland
6,050,402 A 4/2000 Walter
6,065,590 A 5/2000 Spivey
6,070,790 A 6/2000 Anderson
6,085,969 A 7/2000 Burgoyne
6,105,853 A 8/2000 Lamare
6,105,854 A 8/2000 Spivey et al.
6,112,977 A 9/2000 Sutherland et al.
6,129,266 A 10/2000 Oliff et al.
6,131,803 A 10/2000 Oliff et al.
6,164,526 A 12/2000 Dalvey
6,170,741 B1 1/2001 Skolik et al.
6,176,419 B1 1/2001 Holley, Jr.
6,227,367 B1 5/2001 Harrelson et al.
6,250,542 B1 6/2001 Negelen
6,260,755 B1 7/2001 Bates et al.
6,283,293 B1 9/2001 Lingamfelter
6,302,320 B1 10/2001 Stout
6,371,365 B1 4/2002 Doucette et al.
6,409,077 B1 6/2002 Telesca et al.
D459,927 S 7/2002 Flowers et al.
6,425,520 B1 7/2002 Peterson
6,471,120 B1 10/2002 Vogel
6,478,219 B1 11/2002 Holley, Jr.
6,484,903 B2 11/2002 Spivey et al.
6,523,739 B2 2/2003 Heeley et al.
6,536,656 B2 3/2003 Auclair et al.
6,550,615 B2 4/2003 Lingamfelter
6,557,699 B1 5/2003 Focke et al.
6,578,736 B2 6/2003 Spivey
6,604,677 B1 8/2003 Sutherland et al.
6,631,803 B2 10/2003 Rhodes et al.
6,669,083 B2 12/2003 Bates
6,715,639 B2 4/2004 Spivey
6,752,262 B1 6/2004 Boriani et al.
6,758,337 B2 7/2004 Chargueraud et al.
6,766,940 B2 7/2004 Negelen
6,789,673 B2 9/2004 Lingamfelter
6,834,793 B2 12/2004 Sutherland
6,848,573 B2 2/2005 Gould et al.
6,866,186 B2 3/2005 Fogle et al.
6,869,009 B2 3/2005 Sutherland et al.
6,899,221 B2 5/2005 Skolik et al.
6,902,104 B2 6/2005 Holley, Jr. et al.
6,905,066 B2 6/2005 Holley
6,918,487 B2 7/2005 Harrelson
6,926,193 B2 8/2005 Smalley
6,929,172 B2 8/2005 Bates et al.
6,932,265 B2 8/2005 Sax et al.
6,945,450 B2 9/2005 Rusnock
6,968,992 B2 11/2005 Schuster
6,969,172 B2 11/2005 Actis-Datta
6,974,072 B2 12/2005 Harrelson
6,991,107 B2 1/2006 Harrelson
6,997,316 B2 2/2006 Sutherland
7,000,803 B2 2/2006 Miller
7,007,836 B2 3/2006 Smalley
7,073,665 B2 7/2006 Auclair et al.
7,104,435 B2 9/2006 Holley, Jr.
7,134,593 B2 11/2006 Harrelson
7,159,759 B2 1/2007 Sutherland et al.
7,225,930 B2 6/2007 Ford et al.
7,234,596 B2 6/2007 Lebras
7,296,731 B2 11/2007 Auclair et al.
7,380,701 B2 6/2008 Fogle et al.
7,416,109 B2 8/2008 Sutherland
7,422,104 B2 9/2008 Perkinson
7,427,010 B2 9/2008 Sutherland
7,472,791 B2 1/2009 Spivey, Sr.
7,478,743 B2 1/2009 Holley, Jr.
7,601,111 B2 10/2009 Sutherland et al.
7,604,157 B2 10/2009 Zammit et al.
7,699,215 B2 4/2010 Spivey, Sr.
7,708,186 B2 5/2010 Pawlick
7,743,944 B2 6/2010 Ho Fung et al.
7,743,968 B2 6/2010 Theelen
7,743,970 B2 6/2010 Bates et al.
7,748,603 B2 7/2010 Fogle et al.
7,757,933 B2 7/2010 Dunn
7,780,067 B2 8/2010 Holley
7,793,779 B2 9/2010 Spivey, Sr. et al.
7,806,314 B2 10/2010 Sutherland
7,832,621 B2 11/2010 Smalley
7,984,843 B2 7/2011 Cooper et al.
8,216,118 B2 7/2012 Dunn
8,356,743 B2 1/2013 Spivey, Sr.
8,356,744 B2 1/2013 Brand et al.
8,376,214 B2 2/2013 Spivey, Sr. et al.
8,387,855 B2 3/2013 Brand
8,397,979 B2 3/2013 Bates
8,439,194 B2 5/2013 Spivey
8,453,919 B2 6/2013 Eckermann et al.
8,459,533 B2 6/2013 Requena et al.
8,602,292 B2 12/2013 Brand
9,033,209 B2 5/2015 Fogle et al.
9,073,663 B2 7/2015 Holley et al.
9,187,206 B2 11/2015 Holley, Jr.
2002/0029991 A1 3/2002 Lingamfelter
2002/0070139 A1 6/2002 Bates
2002/0088820 A1 7/2002 Spivey
2002/0088821 A1 7/2002 Spivey et al.
2002/0185499 A1 12/2002 Harrelson et al.
2003/0006158 A1 1/2003 Skolik et al.
2003/0136820 A1 7/2003 Negelen
2003/0141313 A1 7/2003 Bates

(56) References Cited

U.S. PATENT DOCUMENTS

| | | | | |
|---|---|---|---|---|
| 2003/0150759 | A1 | 8/2003 | White, Jr. | |
| 2003/0192907 | A1 | 10/2003 | Bates | |
| 2003/0213263 | A1 | 11/2003 | Woog | |
| 2004/0040334 | A1 | 3/2004 | Rusnock | |
| 2004/0050917 | A1 | 3/2004 | Smalley | |
| 2004/0060972 | A1 | 4/2004 | Harrelson | |
| 2004/0074954 | A1 | 4/2004 | Fogle et al. | |
| 2004/0089575 | A1 | 5/2004 | Lingamfelter | |
| 2004/0089671 | A1 | 5/2004 | Miller | |
| 2004/0099558 | A1 | 5/2004 | Oliff et al. | |
| 2004/0155098 | A1 | 8/2004 | Harrelson | |
| 2004/0188277 | A1 | 9/2004 | Auclair | |
| 2004/0188300 | A1 | 9/2004 | Sutherland | |
| 2004/0188504 | A1* | 9/2004 | Pierce | B65D 5/029 229/109 |
| 2004/0188508 | A1 | 9/2004 | Holley, Jr. et al. | |
| 2004/0262374 | A1 | 12/2004 | Chargueraud | |
| 2005/0023170 | A1 | 2/2005 | Lingamfelter | |
| 2005/0056658 | A1 | 3/2005 | Spivey | |
| 2005/0087592 | A1 | 4/2005 | Schuster | |
| 2005/0092820 | A1 | 5/2005 | Chekroune | |
| 2005/0115843 | A1 | 6/2005 | Harrelson | |
| 2005/0126947 | A1 | 6/2005 | Holley, Jr. | |
| 2005/0167291 | A1 | 8/2005 | Sutherland | |
| 2005/0167478 | A1 | 8/2005 | Holley, Jr. | |
| 2005/0189405 | A1 | 9/2005 | Gomes et al. | |
| 2005/0247767 | A1 | 11/2005 | Smalley | |
| 2005/0263574 | A1 | 12/2005 | Schuster | |
| 2006/0054522 | A1 | 3/2006 | Kline et al. | |
| 2006/0071058 | A1 | 4/2006 | Spivey, Sr. | |
| 2006/0081691 | A1 | 4/2006 | Smalley | |
| 2006/0091193 | A1 | 5/2006 | DeBusk et al. | |
| 2006/0118606 | A1 | 6/2006 | Holley, Jr. et al. | |
| 2006/0131370 | A1 | 6/2006 | Bates | |
| 2006/0169755 | A1 | 8/2006 | Spivey, Sr. | |
| 2006/0175386 | A1 | 8/2006 | Holley, Jr. | |
| 2006/0231441 | A1 | 10/2006 | Gomes | |
| 2006/0231600 | A1 | 10/2006 | Holley, Jr. | |
| 2006/0249413 | A1 | 11/2006 | Auclair et al. | |
| 2006/0273143 | A1 | 12/2006 | Finch | |
| 2006/0278689 | A1 | 12/2006 | Boshinski et al. | |
| 2007/0007325 | A1 | 1/2007 | Suzuki et al. | |
| 2007/0029371 | A1 | 2/2007 | Theelen | |
| 2007/0039846 | A1 | 2/2007 | Spivey, Sr. | |
| 2007/0051781 | A1 | 3/2007 | Holley, Jr. | |
| 2007/0108261 | A1 | 5/2007 | Schuster | |
| 2007/0131748 | A1 | 6/2007 | Brand | |
| 2007/0164091 | A1 | 7/2007 | Fogle et al. | |
| 2007/0164093 | A1 | 7/2007 | Spivey et al. | |
| 2007/0181658 | A1 | 8/2007 | Sutherland | |
| 2007/0199979 | A1* | 8/2007 | Holley | B65D 71/36 229/103.2 |
| 2007/0205255 | A1 | 9/2007 | Dunn | |
| 2007/0210144 | A1 | 9/2007 | Brand | |
| 2007/0251982 | A1 | 11/2007 | Brand | |
| 2007/0284424 | A1 | 12/2007 | Holley | |
| 2007/0295789 | A1 | 12/2007 | Ho Fung | |
| 2007/0295790 | A1 | 12/2007 | Zammit et al. | |
| 2008/0023535 | A1 | 1/2008 | Holley, Jr. | |
| 2008/0048014 | A1 | 2/2008 | Bates | |
| 2008/0099544 | A1 | 5/2008 | Skolik | |
| 2008/0119344 | A1 | 5/2008 | Sutherland et al. | |
| 2008/0128479 | A1 | 6/2008 | Bates et al. | |
| 2008/0257943 | A1 | 10/2008 | Blin | |
| 2009/0236408 | A1 | 9/2009 | Spivey, Sr. | |
| 2009/0255983 | A1 | 10/2009 | De Paula et al. | |
| 2009/0282843 | A1 | 11/2009 | Brand | |
| 2010/0044420 | A1 | 2/2010 | Brand et al. | |
| 2010/0108747 | A1 | 5/2010 | Brand | |
| 2010/0122999 | A1 | 5/2010 | Brand | |
| 2010/0213249 | A1 | 8/2010 | Requena | |
| 2010/0237138 | A1 | 9/2010 | Bradford | |
| 2011/0011924 | A1 | 1/2011 | Spivey et al. | |
| 2011/0049228 | A1 | 3/2011 | Brand | |
| 2011/0068160 | A1 | 3/2011 | Brand et al. | |
| 2011/0198393 | A1 | 8/2011 | Bates | |
| 2011/0240725 | A1* | 10/2011 | Spivey, Sr. | B65D 5/0227 229/117.16 |
| 2011/0248078 | A1 | 10/2011 | Holley, Jr. | |
| 2011/0290692 | A1 | 12/2011 | Spivey, Sr. | |
| 2012/0067755 | A1 | 3/2012 | Spivey, Sr. | |
| 2012/0091021 | A1 | 4/2012 | Smalley | |
| 2012/0279897 | A1 | 11/2012 | Schmal et al. | |
| 2012/0292379 | A1 | 11/2012 | Bates | |
| 2013/0118942 | A1 | 5/2013 | Smalley et al. | |
| 2013/0119122 | A1 | 5/2013 | Spivey, Sr. | |
| 2013/0146649 | A1* | 6/2013 | Spivey, Sr. | B65D 71/36 229/117.13 |
| 2013/0292285 | A1 | 11/2013 | Kastanek | |
| 2014/0021082 | A1 | 1/2014 | Holley, Jr. | |
| 2014/0151444 | A1 | 6/2014 | Fogle et al. | |
| 2014/0224864 | A1 | 8/2014 | Spivey et al. | |

FOREIGN PATENT DOCUMENTS

| | | | |
|---|---|---|---|
| CA | 877792 | | 8/1971 |
| CA | 2 160 145 | | 9/1995 |
| CN | 1320094 | A | 10/2001 |
| CN | 103534178 | A | 1/2014 |
| CN | 104114459 | A | 10/2014 |
| DE | 85 14 718.4 | | 6/1985 |
| DE | G 93 12 950.5 | | 10/1993 |
| DE | 296 07 374 | | 4/1996 |
| DE | 298 15 677 | | 11/1998 |
| DE | 201 12 228 | | 11/2002 |
| DE | 2004 018 649 | | 4/2005 |
| EP | 0 066 029 | | 12/1982 |
| EP | 341089 | | 11/1989 |
| EP | 0 412 226 | | 2/1991 |
| EP | 0 473 266 | | 3/1992 |
| EP | 1 433 714 | | 6/2004 |
| EP | 1 612 157 | | 1/2006 |
| EP | 1 698 565 | | 9/2006 |
| FR | 1 494 239 | | 9/1967 |
| FR | 2 549 010 | | 1/1985 |
| FR | 2 579 175 | | 9/1986 |
| GB | 2 264 101 | | 8/1993 |
| GB | 2 285 252 | A | 7/1995 |
| JP | 8-503187 | | 4/1996 |
| JP | 2002-128064 | | 5/2002 |
| JP | 2002-362537 | | 12/2002 |
| JP | 2005-507831 | | 3/2005 |
| JP | 2006-111342 | | 4/2006 |
| JP | 2007-55630 | | 3/2007 |
| JP | 2007-532421 | | 11/2007 |
| JP | 2010-149927 | | 7/2010 |
| KR | 10-0154124 | | 2/1999 |
| KR | 10-0371048 | | 8/2003 |
| KR | 20-0356729 | | 7/2004 |
| WO | WO 94/10047 | | 5/1994 |
| WO | WO 96/21603 | | 7/1996 |
| WO | WO 96/27538 | | 9/1996 |
| WO | WO 96/29260 | | 9/1996 |
| WO | WO 99/28198 | | 6/1999 |
| WO | WO 99/28207 | | 6/1999 |
| WO | WO 99/64301 | | 12/1999 |
| WO | WO 00/03937 | | 1/2000 |
| WO | WO 00/78618 | | 12/2000 |
| WO | WO 00/78618 | A1 | 12/2000 |
| WO | WO 01/66434 | | 9/2001 |
| WO | WO 02/47990 | | 6/2002 |
| WO | WO 03/037742 | | 5/2003 |
| WO | WO 2004/043790 | | 5/2004 |
| WO | WO 2005/051781 | | 6/2005 |
| WO | WO 2005/080218 | | 9/2005 |
| WO | WO 2005/100175 | | 10/2005 |
| WO | WO 2005/123532 | | 12/2005 |
| WO | WO 2006/050210 | | 5/2006 |
| WO | WO 2006/050316 | | 5/2006 |
| WO | WO 2007/005908 | | 1/2007 |
| WO | WO 2007/076544 | | 7/2007 |
| WO | WO 2007/089282 | | 8/2007 |

(56) References Cited

FOREIGN PATENT DOCUMENTS

| | | |
|---|---|---|
| WO | WO 2008/061168 A2 | 5/2008 |
| WO | WO 2012/003251 | 1/2012 |
| WO | WO 2014/011868 A1 | 1/2014 |

OTHER PUBLICATIONS

Supplementary European Search Report for EP 15 85 5047 dated Mar. 27, 2018.
Notification of the First Office Action for Chinese Application No. 201580058845.9 dated Sep. 17, 2018, with English translation.

* cited by examiner

CARTON WITH HANDLE

CROSS-REFERENCE TO RELATED APPLICATION

This application claims the benefit of U.S. Provisional Patent Application No. 62/122,816, filed Oct. 30, 2014.

INCORPORATION BY REFERENCE

The disclosure of U.S. Provisional Patent Application No. 62/122,816, which was filed on Oct. 30, 2014, and U.S. Provisional Patent Application No. 61/997,147, which was filed on May 22, 2014, are hereby incorporated by reference for all purposes as if presented herein in their entirety.

BACKGROUND OF THE DISCLOSURE

The present disclosure generally relates to cartons for holding beverage containers or other types of articles. More specifically, the present disclosure relates to cartons having handle features for strengthening the handle.

SUMMARY OF THE DISCLOSURE

In general, one aspect of the disclosure is directed to a carton for holding a plurality of articles. The carton comprises a plurality of panels that extends at least partially around an interior of the carton. The carton comprises a first end flap foldably connected to a first panel of the plurality of panels and a second end flap foldably connected to a second panel of the plurality of panels. The first end flap and the second end flap form a closed end of the carton. The carton further comprises a handle comprising a first handle feature in the first end flap and a second handle feature in the second end flap. The first and second handle features are configured for directing stress and controlling tearing of the carton when force is applied to the handle.

In another aspect, the disclosure is generally directed to a carton blank for forming a carton for holding a plurality of containers. The blank comprises a plurality of panels, a first end flap foldably connected to a first panel of the plurality of panels and a second end flap foldably connected to a second panel of the plurality of panels. The first end flap and the second end flap are configured to form a closed end of a carton formed form the blank. The blank further comprises a first handle feature and a second handle feature for forming a handle. The first handle is in the first end flap and the second handle feature is in the second end flap. The first and second handle features re configured for directing stress and controlling tearing of the carton formed from the blank when force is applied to the handle.

In another aspect, the disclosure is generally directed to a method of forming a carton. The method for forming a carton comprises obtaining a blank comprising a plurality of panels, a first end flap foldably connected to a first panel of the plurality of panels, a second end flap foldably connected to a second panel of the plurality of panels, a first handle feature in the first end flap and a second handle feature in the second end flap. The method comprises forming an interior of the carton at least partially defined by the plurality of panels and inserting a plurality of articles into the interior of the carton. The method further comprises at least partially overlapping the first end flap and the second end flap with respect to one another to at least partially form a closed end of the carton. The method further comprises forming a handle in the closed end from the handle features. The first handle feature and the second handle feature are configured for directing stress and controlling tearing of the carton when force is applied to the handle.

Those skilled in the art will appreciate the above stated advantages and other advantages and benefits of various additional embodiments reading the following detailed description of the embodiments with reference to the below-listed drawing figures. It is within the scope of the present disclosure that the above-discussed aspects be provided both individually and in various combinations.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present disclosure generally relates to cartons that contain articles such as containers, bottles, cans, etc. The articles can be used for packaging food and beverage products, for example. The articles can be made from materials suitable in composition for packaging the particular food or beverage item, and the materials include, but are not limited to, aluminum and/or other metals; glass; plastics such as PET, LDPE, LLDPE, HDPE, PP, PS, PVC, EVOH, and Nylon; and the like, or any combination thereof.

Cartons according to the present disclosure can accommodate articles of any shape. For the purpose of illustration and not for the purpose of limiting the scope of the disclosure, the following detailed description describes beverage containers (e.g., glass beverage bottles) as disposed within the carton embodiments. In this specification, the terms "lower," "bottom," "upper," and "top" indicate orientations determined in relation to fully erected and upright cartons.

Figure 1:
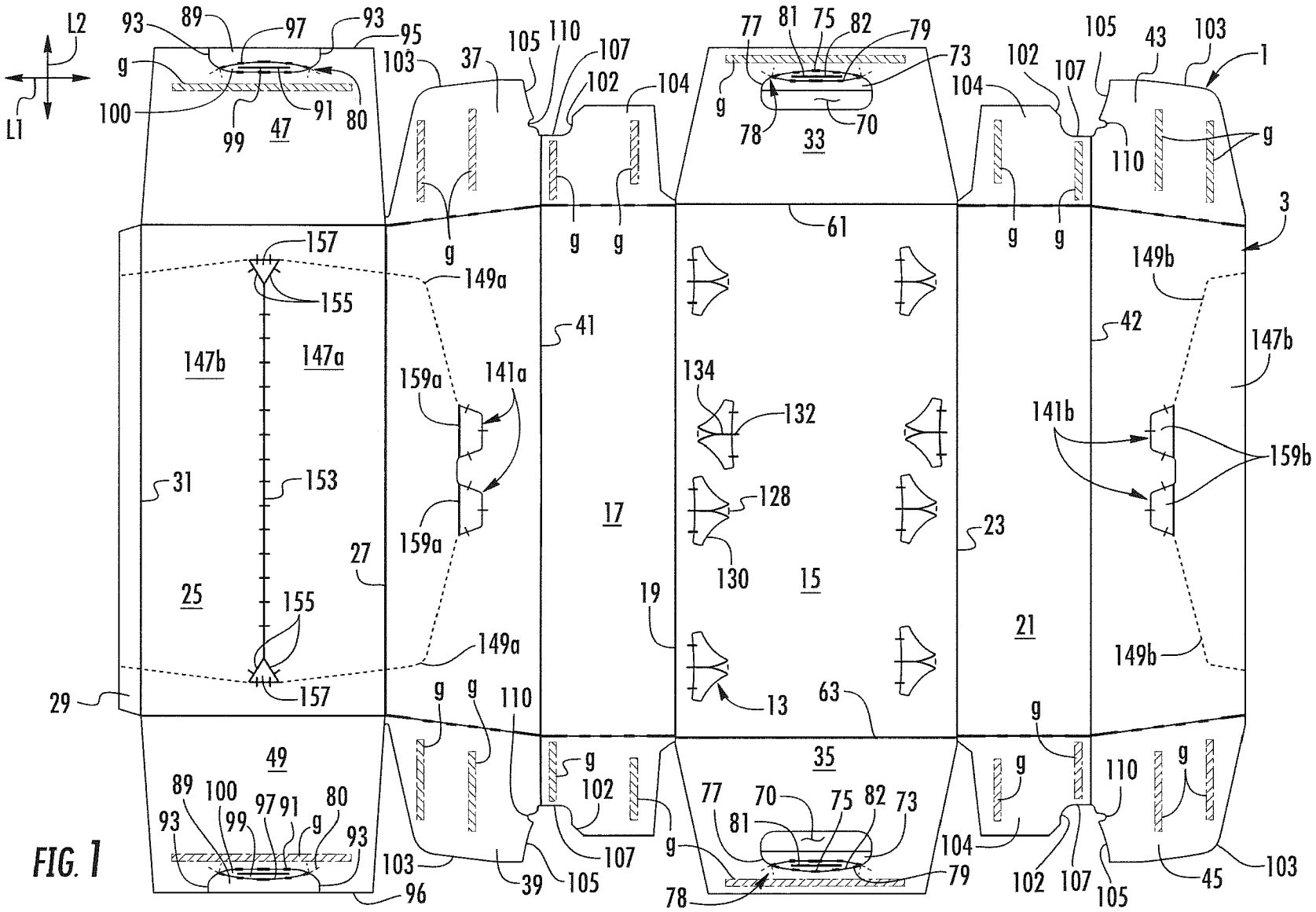
FIG. 1 is an exterior plan view of a blank used to form a carton according to an exemplary embodiment of the disclosure.
Figure 4A:
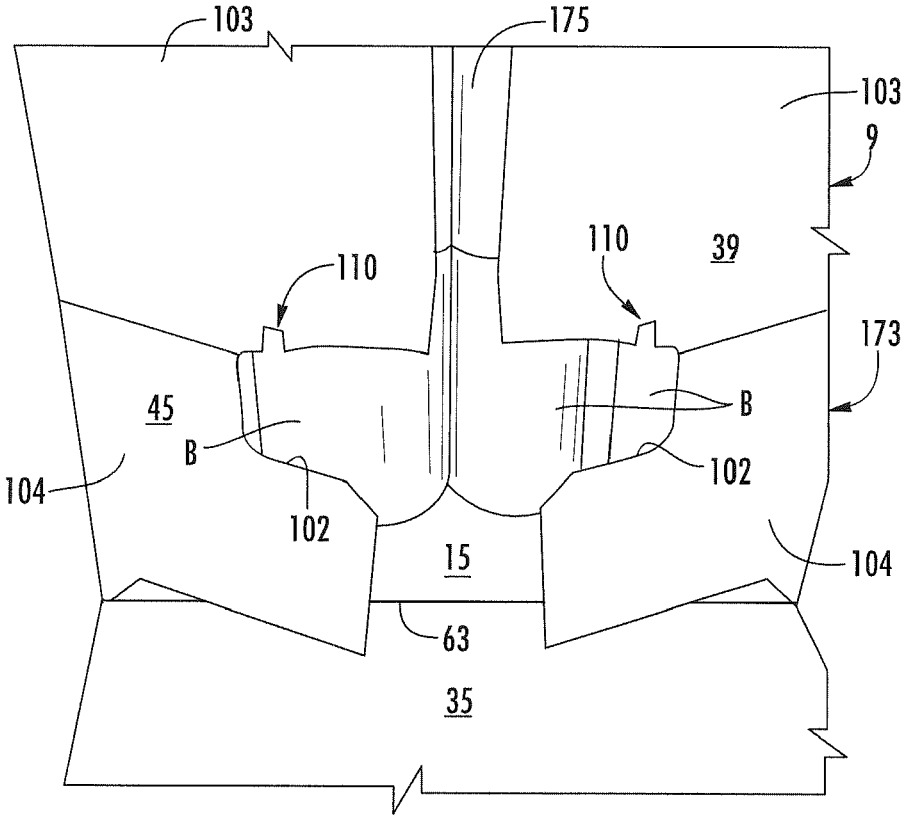
FIGS. 4A-5 are perspective views of a partially assembled carton according to an exemplary embodiment of the disclosure.
Figure 4B:
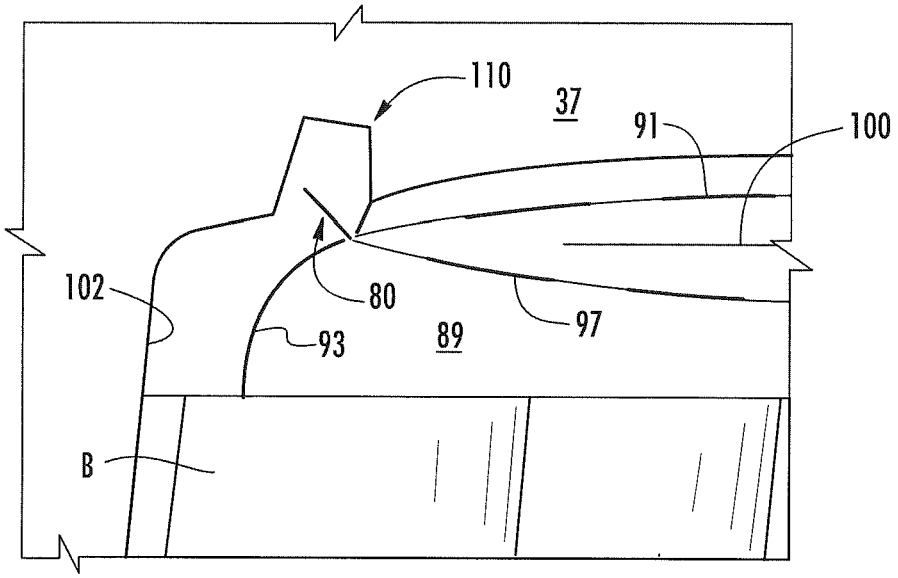

FIG. 1 is a plan view of the exterior side 1 of a blank, generally indicated at 3, used to form a carton 5 (FIG. 6) according to an exemplary embodiment of the disclosure. The carton 5 can be used to house a plurality of articles such as containers in the form of beverage bottles B (FIG. 4A). In the illustrated embodiment, the carton 5 is sized to house twenty-six bottles B in a single layer in a "nested" (e.g., an "internal" or "inverted" nested) arrangement having two outer rows of seven bottles per row and two inner rows of six bottles per row. The containers B could be arranged any other suitable arrangement, such as one of the many nested configurations illustrated in U.S. Provisional Patent Application No. 61/997,147 that has been incorporated by reference herein, or any other suitable arrangement of containers. Further, the containers B can be cans or bottles without departing from the disclosure. Also, the containers B can be arranged in a "non-nested" configuration such as a single layer in a 3×4 arrangement, or any other arrangement in a single layer or multiple layer (e.g., 1×6, 2×6, 4×6, 3×8, 2×6×2, 3×4×2, 2×9, 3×6, etc.) without departing from the disclosure. In the illustrated embodiment, the carton 5 includes a first end 7 and a second end 9, each with a respective handle, generally indicated at 10 (FIG. 6) for grasping and carrying the carton at each of the ends 7, 9. The carton 5 could have only a single handle 10 in either of the ends 7, 9 without departing from the disclosure. As will be discussed below in more detail, the blank 3, carton 5, and handles 10 each have various features for strengthening the handles and directing stress in the closed ends 7, 9 of the carton.

The carton blank 3 has a longitudinal axis L1 and a lateral axis L2. In the embodiment of FIG. 1, the blank includes a bottom panel 15 foldably connected to a first side panel 17 at a lateral fold line 19. A second side panel 21 is foldably connected to the bottom panel 15 at a lateral fold line 23. A top panel 25 is foldably connected to the first side panel 17 at a lateral fold line 27, and an adhesive panel 29 is foldably connected to the top panel 25 at a lateral fold line 31. Any of the top and bottom panels 25, 15, the adhesive panel 29, and the first and second side panels 17, 21 can be otherwise shaped, arranged, configured, or omitted, without departing from the disclosure. For example, the attachment flap 29 can be foldably connected to the second side panel 21.

The bottom panel 15 is foldably connected to a first bottom end flap 33 and a second bottom end flap 35. The first side panel 17 is foldably connected to a first side end flap 37 and a second side end flap 39. The second side panel 21 is foldably connected to a third side end flap 43 and a fourth side end flap 45. The top panel 25 is foldably connected to a first top end flap 47 and a second top end flap 49. In one embodiment, when the carton 5 is erected, the end flaps 33, 37, 43, 47 close the first end 7 of the carton, and the end flaps 35, 39, 45, 49 close the second end 9 of the carton. In accordance with an alternative embodiment of the present disclosure, different flap arrangements can be used for closing the ends 7, 9 of the carton 5.

The end flaps 33, 37, 43, 47 extend along a first marginal area of the blank 3, and are foldably connected at a first longitudinal fold line 61 that extends along the length of the blank. The end flaps 35, 39, 45, 49 extend along a second marginal area of the carton blank 3, and are foldably connected at a second longitudinal fold line 63 that also extends along the length of the blank. The longitudinal fold lines 61, 63 may be, for example, substantially straight, or offset at one or more locations to account for blank thickness or for other factors. The ends of the carton 5 could be otherwise shaped, arranged, and/or configured (e.g., at least partially tapered) without departing from the disclosure.

In one embodiment, the carton 5 may have article protection flaps 13 in the bottom panel 15 for protecting the plurality of containers B. The article protection flaps 13 are movable between a first position coplanar with the bottom panel 15 (FIG. 1) and a second position upwardly folded from the first position (not shown) and placed between adjacent containers B in the carton to reduce movement of the containers in the carton and prevent breakage of the containers. The article protection features and flaps can be similar to, or the same as, those described in U.S. patent application Ser. No. 13/419,740, filed Mar. 14, 2012, the disclosure of which is herein incorporated by reference. The article protection flaps 13 can be otherwise shaped, arranged, and/or configured without departing from the disclosure. Further, the article protection flaps 13 can be omitted without departing from the disclosure.

As shown in FIG. 1, each of the side panels 17, 21 include a respective lateral fold line 41, 42 extending across each respective side panel and across the respective end flaps 37, 39. One or more of the fold lines 41, 42 could be omitted or could be otherwise shaped, arranged, configured, and/or positioned without departing from the disclosure.

In one embodiment, the carton blank 3 includes eight article protection flaps 13 arranged in a 2×4 arrangement in the bottom panel 15, but the blank could have more or less than eight article protection flaps, and the flaps could be otherwise arranged in other suitable row/column arrangements or in a random configuration on the bottom panel 15, including a single row or single column configuration, or any other suitable configuration. In other embodiments, the carton blank 3 can include article protection flaps that are different, similar, or identical to other article protection flaps without departing from the disclosure. In the embodiment of FIG. 1, the article protection flaps 13 on the second row from the fold line 61 are oriented 180 degrees relative to a row of article protection flaps that are closer to the respective longitudinal fold lines 61, 63. In other embodiments, the article protection flaps 13 could be otherwise shaped, arranged, configured, and/or omitted without departing from the disclosure.

As shown in FIG. 1, the article protection flaps 13 have a respective v-shaped fold line 128 and a generally longitudinal fold line 134 extending from the v-shaped fold line. The article protection flaps 13 are each defined by a cut 130 in the bottom panel that extends from the v-shaped fold line 128. Alternatively, the cut 130 could comprises other forms of weakening (e.g., a tear line that comprises cut lines separated by breakable nicks, a tear line that is formed by a series of spaced apart cuts, etc.) that allows the article protection flap 13 to separated from the bottom panel 15 without departing from the disclosure. In one embodiment, a slit or cut 132 extends laterally from a portion of the cut 130 that is opposite to the v-shaped fold line 128. The article protection flaps 13 are shaped for folding at the v-shaped fold line 128 and the fold line 34 when the article protection flaps are upwardly folded relative to the bottom panel and positioned between adjacent containers B in the carton. The article protection flaps 13 form a tight fit of the containers B in the carton 5 and provide a cushion between adjacent containers B to prevent breakage of the containers in the package. The fold lines 128, 134 and cuts 130, 132 could be otherwise shaped, arranged, configured, and/or omitted such that the article protection flap 13 has any other suitable shape or configuration without departing from the disclosure.

As shown in FIG. 1, the blank 3 includes dispenser features for forming a dispenser 143 (FIG. 6) in the carton 5. As shown in FIG. 1, the dispenser features are formed in the first side panel 17, second side panel 21, and the top panel 25. The dispenser 143 includes two dispenser panels 147*a*, 147*b* that are separable from the first top panel 25 and side panels 17, 21 along tear lines 149*a*, 149*b*. The dispenser panels 147*a*, 147*b* are separable from one another along a lateral tear or cut line 153 and can remain hingedly attached or can be entirely removed from the carton. V-shaped cuts 155 at each end of the cut line 153 define triangular removable portions 157 in the top panel 25. The tear lines 149*a*, 149*b*, cut line 153, and V-shaped cuts 155 could be otherwise shaped, arranged, and/or configured without departing from the disclosure.

As illustrated in FIG. 1, the dispenser features may include two finger tabs 141*a* along the tear line 149*a* formed in the first side panel 17 and two finger tabs 141*b* along the tear line 149*b* formed in the second side panel 21. The finger tabs 141*a*, 141*b* are respectably foldably connected to the dispenser panels 147*a*, 147*b* along lateral fold lines 159*a*, 159*b*. When the finger tabs are pushed in or activated an access opening (not shown) is formed along the tear line in the side panels 17, 21 to allow a user to more easily separate the dispenser panels 147*a*, 147*b* along the tear lines.

In the embodiment of FIG. 1, the carton blank 3 has handle features for forming the handles 10. As noted above, the handles 10 in each end 7, 9 of the carton 5 are identical in the illustrated embodiment, so the features of one handle will be described herein, and like reference numbers will be used to refer to the features of both handles. As shown in FIG. 1, the handle features comprise a handle opening 70 in the bottom end flaps 33, 35 and a handle flap (i.e., outer handle flap) 73 foldably connected to the respective bottom end flaps 33, 35 at an arcuate fold line 75. In one embodiment, the handle flap 73 is adjacent the handle opening 70 and has a free edge that partially defines the handle opening 70. The handle flap 73 is defined by cuts 77 in the bottom end flaps 33, 35 that extend from ends of the arcuate fold line 75. In one embodiment, the handle 10 includes an opposing arcuate fold line 79 opposite the arcuate fold line 75 that extends in each of the outer handle flaps 73 and generally mirrors the arcuate fold line 75. In the illustrated embodiment, the arcuate fold lines 75, 79 are cut-crease lines; however, the fold lines could be otherwise configured (e.g., scores, creases, perforations, etc.). A hand contact portion 82 (FIG. 7) can be generally defined between the arcuate fold line 75 and the opposing arcuate fold line 79 in each of the outer handle flaps 73. Accordingly, as the outer handle panel 73 is folded inwardly, the outer handle panel folds along both of the arcuate fold lines 75, 79 so that the hand contact portions 82 form a wider contact area for a user's hands, thereby helping to make the material at the handle 10 feel thicker and more comfortable for the user.

Figure 3:
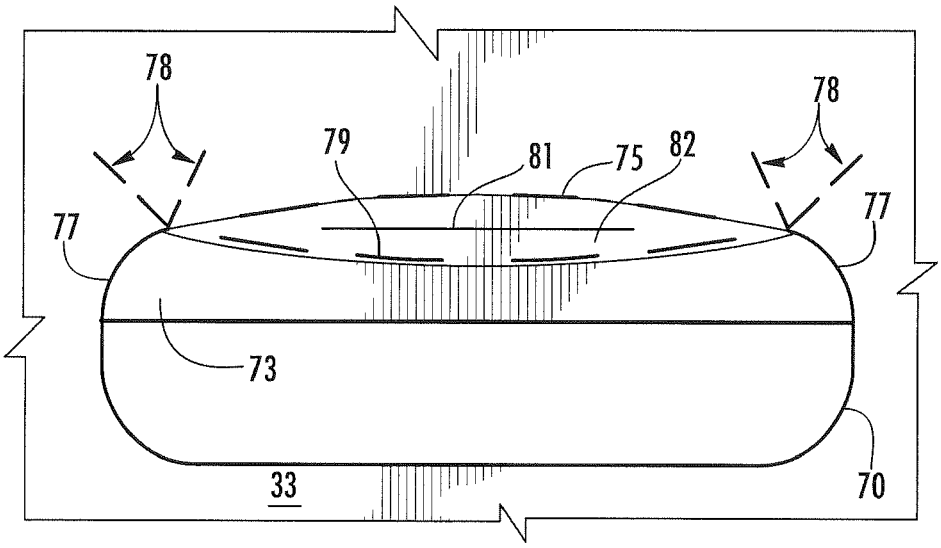
FIG. 3 is an enlarged view of portions of the blank of FIG. 1.

In one embodiment, each outer handle flap 73 includes a longitudinal score 81 extending in the hand contact portion 82. As illustrated in FIG. 3C, the handle features can further include two oblique cuts or v-shaped cuts 78 generally located at the intersections of cuts 77, and arcuate fold lines 75, 79 at opposite ends of the handle flap 73. The v-shaped cuts 78 extend away from the cuts 77 and into the bottom end flap 33, 35 in the direction of a free edge of the bottom end flap. As will be discussed further below, the v-shaped cuts 78 are for directing stress and controlling tearing in the carton 5 when the carton is lifted at the handle. The outer handle flaps 73 could be otherwise shaped, arranged, and/or configured without departing from the disclosure.

Figure 2A:
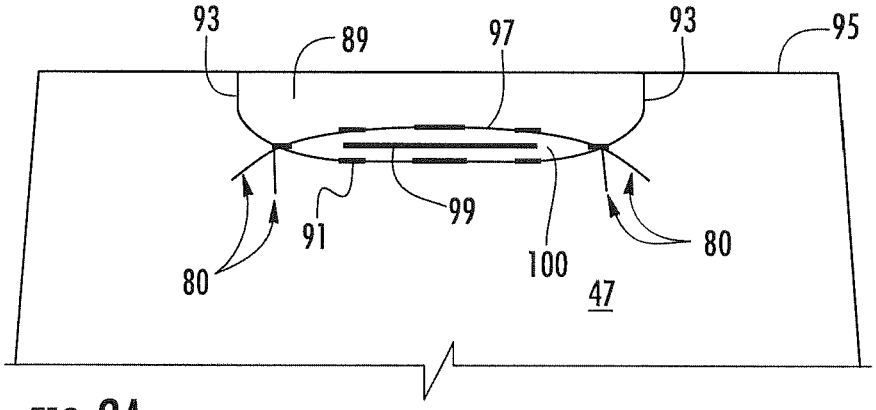
FIGS. 2A-2B are enlarged views of portions of the blank of FIG. 1.
Figure 2B:
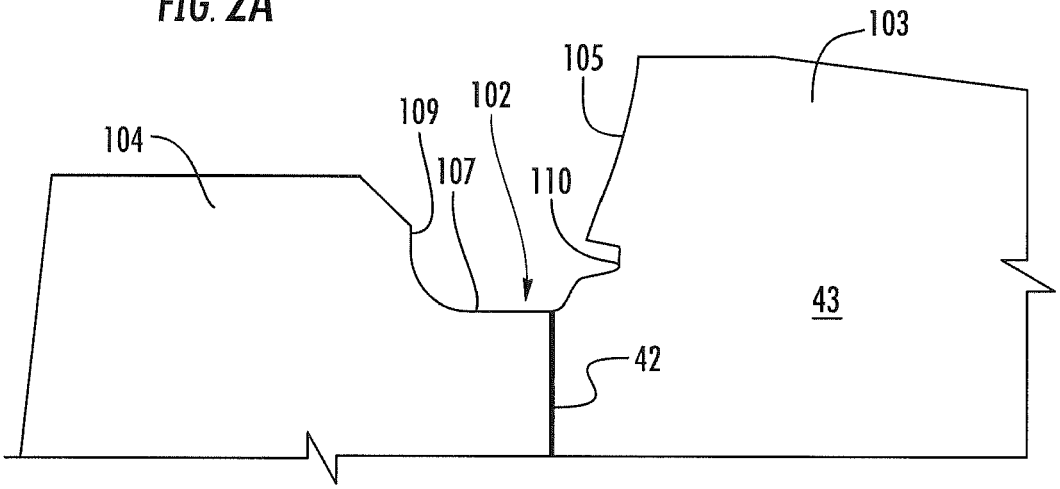

As shown in FIGS. 1 and 2A, the handle features further include a handle flap (e.g., "inner handle flap") 89 defined in each of the top end flaps 47, 49. Each of the inner handle flaps 89 is foldably connected to the respective top end flap 47, 49 along an arcuate fold line 91 and is separable from the respective top end flap along cuts 93. In one embodiment, the inner handle flaps 89 extend adjacent the edge 95, 96 of the top end flaps 47, 49. An opposing arcuate fold line 97 extends in each of the handle flaps 89 and generally mirrors the arcuate fold lines 91. In the illustrated embodiment, the arcuate fold lines 91, 97 can be generally similar to the arcuate fold lines 75, 79 and can be positioned and configured so that the arcuate fold lines 75, 79 generally overlap the arcuate fold lines 91, 97 in the erected carrier 5. In one embodiment, each handle flap 89 includes a longitudinal cut-crease line 99 extending between the arcuate fold line 91 and the opposing arcuate fold line 97. A folding portion 100 can be generally defined between the arcuate fold line 91 and the opposing arcuate fold line 97 in each of the inner handle flaps 89.

In one embodiment, when the handles 10 are formed, the hand contact portions 82 of the outer handle flaps 73 generally overlap the respective folding portions 100, and the folding portions 100 cooperate with the respective hand contact portions 82 to help form the wider contact areas of the handles. As illustrated in FIG. 2A, the handle features can further include two oblique cuts or v-shaped cuts 80 generally located at the intersections of cuts 93, and arcuate fold lines 91, 97 at opposite ends of the handle flap 89. The v-shaped cuts 80 extend away from the cuts 93 and into the top end flap 47, 49. As will be discussed further below, the v-shaped cuts 80 cooperate with the v-shaped cuts 78 of the bottom end flaps 33, 35 to direct stresses and control tearing in the carton 5 when the carton is lifted at the handle 10. The inner handle flaps 89 could be otherwise shaped, arranged, and/or configured without departing from the disclosure.

In the illustrated embodiment, the handle features also include cutouts or handle openings 102 in the side end flaps 37, 39, 43, and 45. In one embodiment, the openings 102 cooperate to provide an opening at a respective closed end 7, 9 to allow a respective outer handle flap 73 and inner handle flap 89 to be inwardly folded at a respective end. The side end flaps 37, 39, 43, 45 can also include respective upper portions 103 disposed on one side of the lateral fold line 41, 42 and lower portions 104 on the other side of the lateral fold line 41, 42. The openings 102 have an upper edge 105 extending inwardly from the edge of the upper portion 103, an inner edge 107, and a lower edge 109 extending from the inner edge 107 to the edge of the lower portion 104 of the end flap 37, 39, 43, 45. In one embodiment, the openings 102 may include a force directing notch or opening 110 generally in the upper edge 105 of the opening 102.

In one embodiment, when the blank is formed into a carton, the force directing notches 110 align with the two v-shaped cuts 78 and 80 to form a weakened area in the ends 7, 9. The force directing notches 110 could be other features (e.g., tear lines, cuts, etc.) or be otherwise shaped, arranged, and/or configured without departing from the disclosure. The blank 3 can have other features for forming the handles 10, or the blank 3 and/or carton 5 can have one or more handles that are alternatively shaped, arranged, and/or configured without departing from the disclosure. For example, any or all of the outer handle flaps 73 or the inner handle flaps 89 could be omitted and the respective end flaps could comprises openings that align to form the handle in one or both ends 7, 9 of the carton. Further, one or both of the handles 10 can be omitted without departing from the disclosure.

In one embodiment, the lateral fold line 41 may extend from the opening 102 in the first end flap 37 across the first side panel 17 to the opening 102 in the second side end flap 39 and the lateral fold line 42 may extend from the opening 102 in the first end flap 43 across the second side panel 21 to the opening 102 in the second side end flap 45. The lateral fold lines 41, 42 could be otherwise shaped, arranged, positioned, and/or omitted without departing from the disclosure.

Figure 5:
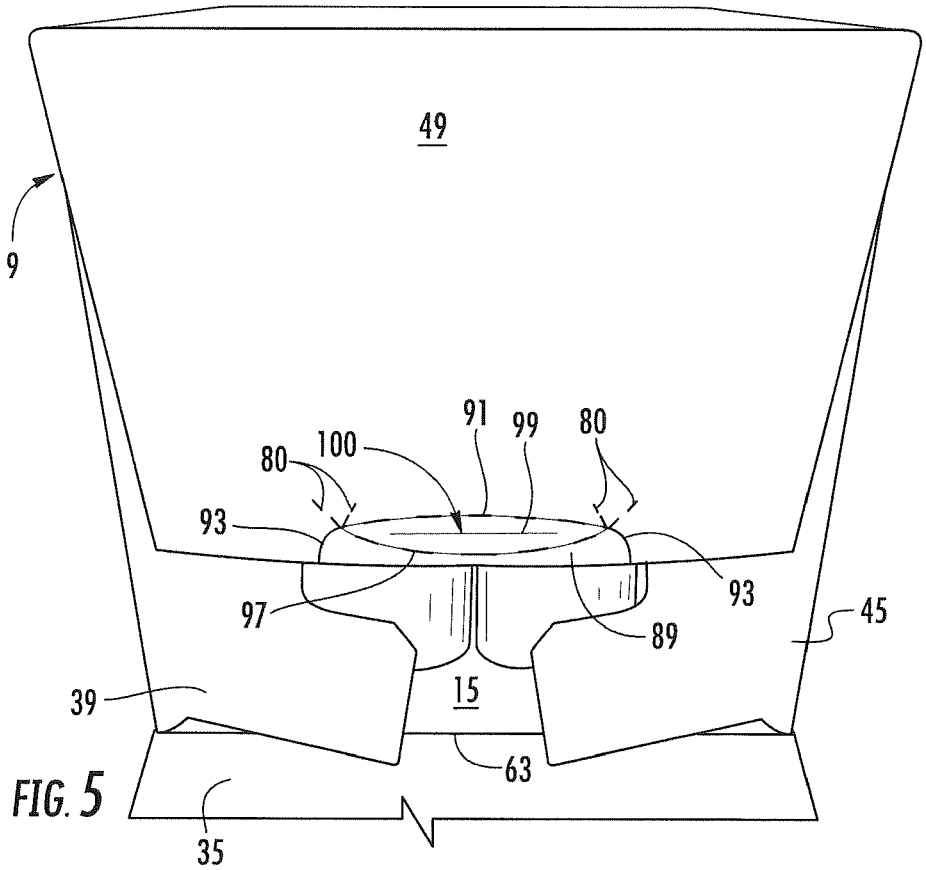
Figure 8:
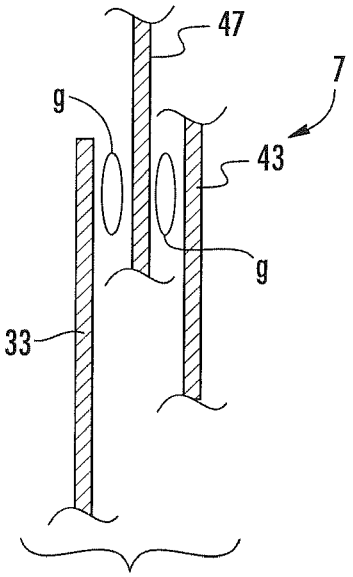
FIG. 8 is a schematic cross-sectional view of a portion of an end of the carton of FIG. 6.

In one embodiment, the carton 5 can be formed from the blank 3 by folding the panels 15, 17, 21, 25 along the lateral fold lines 19, 23, 27, 31 and gluing the adhesive flap 29 to the second side panel 21 to form an open-ended sleeve 173. One or both of the ends 7, 9 can be at least partially closed by folding the end flaps 33, 43, 37, 47 at one end, and by folding the end flaps 35, 45, 39, 49 at the other end. In one embodiment, the containers B can be loaded into the carton before closing one or both of the ends 7, 9. To close the ends 7, 9 of the carton, the side end flaps 37, 43, 39, 45 are folded inwardly (FIG. 4A), the top end flap 47, 49 are folded downwardly to overlap the upper portions 103 of the side end flaps (FIG. 5B), and the bottom end flaps 33, 35 are upwardly folded to overlap the bottom portions 104 of the side end flaps, and a portion of the top end flap. In the illustrated embodiment, one or more of the end flaps 33, 35, 43, 45, 37, 39, 47, 49 are adhered together by glue that can be indicated by glue lines "g" forming reinforcement portions 119 and 121 in the first and second ends 7, 9 of the carton. One of the handle reinforcement portions 119 is shown schematically in FIG. 8 showing the cross-section of a portion of the first end 7 of the carton 5. FIG. 8 schematically shows glue "g" adhering the overlapped portions of the end flaps 33, 43, 47 together.

In one embodiment, when the ends 7, 9 are closed, the handle flaps 73, 89 in the bottom end flaps 33, 35 and top end flaps 47, 49 are generally aligned with the handle openings 102 of each cooperating pair of side end flaps 37, 43 and 39, 45. The v-shaped cuts 78, 80 are respectively aligned with the notches 110 in the openings 102, with the v-shaped cuts 78 of the bottom end flap 33, 35 being in an aligned and overlapping relationship with the v-shaped cuts 80 of the top end flaps 47, 49. In one embodiment, the glue lines g faun a glue seam GS (FIG. 8) above the handle 10 and comprising portions of the side end flaps 37, 43, 39, 45, portions of the top end flaps 47, 49, and portions of the bottom end flaps 33, 35 that are adhered together in a location above the handle. Accordingly, the handle 10 (FIG. 7) in either of the ends 7, 9 is formed by the alignment of the inner handle flap 89 in the top end flap 47, 49, the outer handle flap 73 in the bottom end flap 33, 35, and the handle openings 102 in the side end flaps 37, 43, 39, 45.

Figure 6:
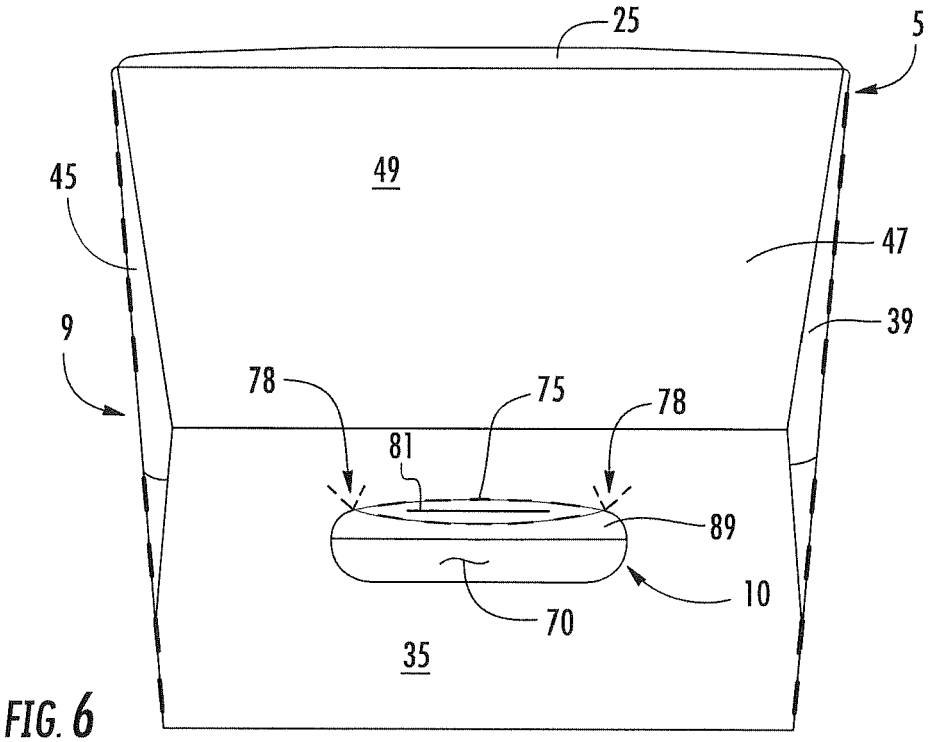
FIGS. 6-7 are perspective views of the carton fully assembled.
Figure 7:
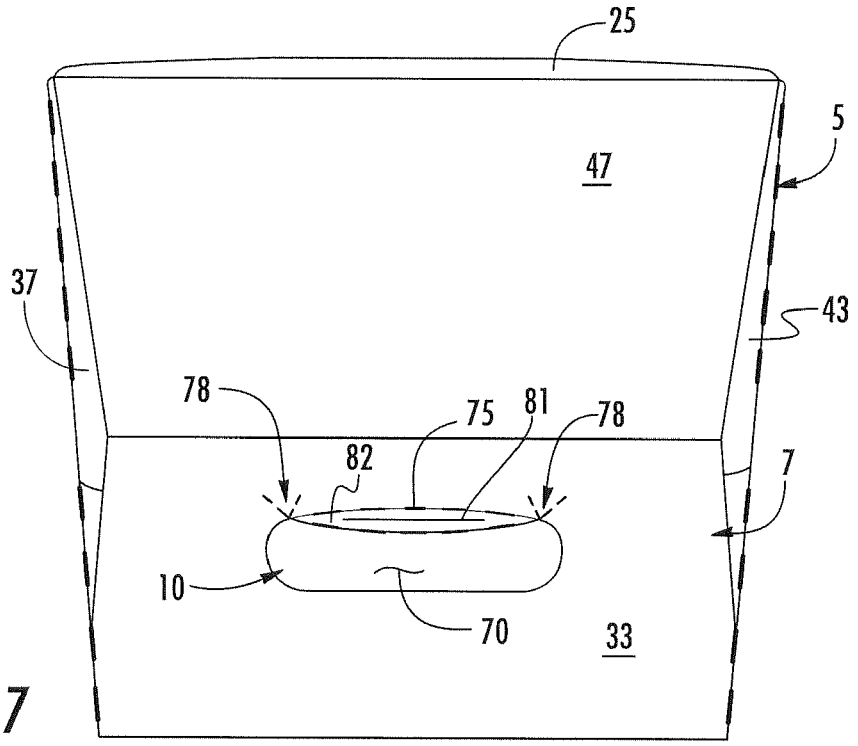

In one embodiment, containers B can be loaded into the partially-erected carton 5 through the open second end 9, and the second end 9 of the carton 5 can be closed in a similar manner as the first end 7 by folding, respectively overlapping, and selectively adhering the side end flaps 39, 45, the top end flap 49 and the bottom end flap 35. The erected carton is shown in FIGS. 6-7. One or both of the ends 7, 9 could be otherwise shaped, arranged, configured, or omitted, without departing from the disclosure. Additionally, the open-ended sleeve 173 can be alternatively loaded with containers and closed without departing from the disclosure. For example, the ends 7, 9 can be closed in any order, and the containers could be loaded before or after closing either or both of the ends 7, 9.

In one embodiment, the inner handle flaps 89 of the top end flaps 47, 49, and the outer handle flap 73 of the bottom end flaps 33, 35 are overlapped and aligned with the handle openings 102 in the side end flaps 37, 43, 39, 45 to form the handle 10 in the ends 7, 9. The handle 10 could be formed by other or features or the features shown could be modified without departing from the disclosure. The handles 10 can be used to grasp the carton 5 by pressing against the outer handle flaps 73 to force the outer handle flaps 73 and the inner handle flaps 89 inwardly through the handle openings 102 of the side end flaps 37, 39, 43, 45 to provide a handle opening in the closed ends 7, 9 of the carton 5. For each of the handles 10, as the outer handle panel 73 and the inner handle panel 89 fold inwardly, the outer handle panel 73 and the inner handle panel can fold inwardly along the respective arcuate fold lines 75, 91. As shown in FIG. 7, the handle panels 73, 89 can be folded upwardly toward the interior surface of the upper portions 103 of the side end flaps along the respective opposing arcuate fold lines 79, 97 as the user grasps the handle 10. Accordingly, the hand contact portions 82 of the outer handle flaps 73 and the folding portions 100 of the inner handle flaps 89 extend at an angle with respect to the top end flaps 47 or 49 and the remainders of the handle flaps 73, 89 to form hand contact areas 177 (FIG. 7). The hand contact areas 177 can provide a wider area that is supported by the user's hands, which is more comfortable than supporting the carton 5 along a single fold line. The opposing arcuate fold lines 75, 79 and 91, 97 help avoid a situation where the weight of the carton 5 and the containers disposed therein are supported by a user's hands at a single fold line in each handle, which could more easily occur if each of the handle panels fold along a single fold line or along parallel fold lines.

In the illustrated embodiment, the hand contact areas 177 of the handle 10 are adjacent a void in the interior of the carton that is created by the internal nesting of the rows of containers B. As a result of the two interior rows of containers having less amount of containers than the two outer rows, the two interior rows are spaced apart from the ends 7, 9 of the carton to allow space for a user to insert a hand at the contact area 177 of the handle to grasp the handle. As noted above, other container configurations (e.g., interior nested, fully nested, or non-nested) could be used with the handle 10 of the carton 5 without departing from the disclosure.

In the illustrated embodiment, the inwardly folding handle flaps 73, 89 can contact the upper edge 105 in the side end flaps 37, 43 or 39, 45. Accordingly, when force is applied to the handles 10 such as when lifting the carton, the weakened areas created by the v-shaped cut lines 78, 80 and the notches 110 direct the stresses in the ends 7, 9 of the carton upward from the handle 10 toward the glue seam GS which is the strongest or most tear resistant portion of the carton. In this manner the features of the handles 10 direct the stresses in the carton 5 toward the glue seam GS thus improving handle strength and resistance to tearing or other failure. The features of the handle 10 (e.g., the weakened areas formed by the v-shaped cuts 78, 80 and notches 110) of the present disclosure direct the forces in the ends 7, 9 of the carton into the area of most tear resistance and prevents or delays failure of the handle by sending the stress in the carton resulting from the lifting force in one direction (e.g., upward from the handle opening or fold lines 75, 91) and then forcing any resulting tear to redirect or form in another direction once it reaches the strongest point of the carton (e.g., glue seam). The handles 10 could be alternatively, shaped, arranged, configured, and/or reinforced without departing from this disclosure.

Any of the features of the various embodiments of the disclosure can be combined with, replaced by, or otherwise configured with other features of other embodiments of the disclosure without departing from the scope of this disclosure. Further, it is noted that the handle flaps with the opposing arcuate fold lines or the nonparallel fold lines of the various embodiments can be incorporated into a carton having any carton style or panel configuration. The carton styles and panel configurations described above are included by way of example. Additionally, the shapes of the handle flaps can be substantially any shape. The shapes described above and included in the figures are included by way of example.

The blank according to the present disclosure can be, for example, formed from coated paperboard and similar materials. For example, the interior and/or exterior sides of the blank can be coated with a clay coating. The clay coating may then be printed over with product, advertising, price coding, and other information or images. The blank may then be coated with a varnish to protect any information printed on the blank. The blank may also be coated with, for example, a moisture barrier layer, on either or both sides of the blank. In accordance with the above-described embodiments, the blank may be constructed of paperboard of a caliper such that it is heavier and more rigid than ordinary paper. The blank can also be constructed of other materials, such as cardboard, hard paper, or any other material having properties suitable for enabling the carton to function at least generally as described herein. The blank can also be laminated or coated with one or more sheet-like materials at selected panels or panel sections.

In accordance with the above-described embodiments of the present disclosure, a fold line can be any substantially linear, although not necessarily straight, form of weakening that facilitates folding there along. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments that are within the scope of the claims. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for holding a plurality of articles, the carton comprising:

a plurality of panels that extends at least partially around an interior of the carton, the plurality of panels comprising a bottom panel, a first side panel foldably connected to the bottom panel, a second side panel foldably connected to the bottom panel, and a top panel foldably connected to at least one of the first side panel and the second side panel;

a first end flap foldably connected to a first panel of the plurality of panels and a second end flap foldably connected to a second panel of the plurality of panels, the first end flap and the second end flap at least partially form a closed end of the carton, wherein the first panel comprises the bottom panel and the second panel comprises one of the first side panel and the second side panel;

a handle comprising a first handle feature in the first end flap and a second handle feature in the second end flap, the first and second handle features being configured for directing stress and controlling tearing of the carton when force is applied to the handle;

wherein the handle comprises a handle flap foldably connected to the first end flap along a fold line and a handle opening in the second end flap, the first handle feature comprises a cut extending from the fold line in a direction away from the handle flap, the second handle feature comprises a notch adjacent the handle opening, the first end flap and the second end flap are in face-to-face relationship, and the cut is aligned with the notch, at least a portion of the cut overlapping the notch.

2. The carton of claim 1, wherein the second end flap overlaps the first end flap.

3. The carton of claim 1, wherein the first end flap overlaps the second end flap.

4. The carton of claim 1, wherein the cut is a v-shaped cut.

5. The carton of claim 1, wherein the fold line is a curved fold line.

6. The carton of claim 1, further comprising a third end flap foldably connected to the top panel and the handle comprises a third handle feature in the third end flap, the handle flap is a first handle flap, and the handle comprises a second handle flap foldably connected to the third end flap at a fold line, and the third handle feature comprises a cut extending from the fold line in the third end flap.

7. The carton of claim 6, wherein the third end flap is in face-to-face relationship with the second end flap.

8. The carton of claim 7 wherein the third end flap overlaps the second end flap and the first end flap overlaps at least the third end flap so that at least the second end flap is adjacent an interior of the carton.

9. The carton of claim 7 wherein the first end flap, the second end flap, and the third end flap form a reinforced portion in the closed end that is above the handle.

10. The carton of claim 9, wherein the first handle feature, the second handle feature, and the third handle feature cooperate to direct tearing in the closed end in an upward direction from the handle towards the reinforced portion.

11. The carton of claim 1, wherein the top panel has a first lateral length and the bottom panel has a second lateral length, and the second lateral length is greater than the first lateral length.

12. The carton of claim 1, further comprises a dispenser in at least one of the top panel, the first side panel, and the second side panel.

13. The carton of claim 12, wherein the dispenser comprises a first dispenser panel separable from the top panel and the first side panel along a first tear line, and a second dispenser panel separable from the top panel and the second side panel along a second tear line.

14. The carton of claim 13, wherein the dispenser comprises at least one finger tab along the first tear line in the first side panel and along the second tear line in the second side panel.

15. The carton of claim 1, further comprises a plurality of article protection flaps foldably connected to the bottom panel.

16. A blank for forming a carton for holding a plurality of articles, the blank comprising:

a plurality of panels, the plurality of panels comprising a bottom panel, a first side panel foldably connected to the bottom panel, a second side panel foldably connected to the bottom panel, and a top panel foldably connected to at least one of the first side panel and the second side panel;

a first end flap foldably connected to a first panel of the plurality of panels and a second end flap foldably connected to a second panel of the plurality of panels, the first end flap and the second end flap being configured to at least partially form a closed end of the carton formed from the blank, wherein the first panel comprises the bottom panel and the second panel comprises one of the first side panel and the second side panel;

a first handle feature and a second handle feature for forming a handle, the first handle feature being in the first end flap and the second handle feature being in the second end flap, the first and second handle features being configured for directing stress and controlling tearing of the carton formed from the blank when force is applied to the handle;

a handle flap foldably connected to the first end flap along a fold line, the first handle feature comprising a cut extending from the fold line in a direction away from the handle flap;

a handle opening in the second end flap, the second handle feature comprising a notch adjacent the handle opening;

wherein the first end flap and the second end flap are configured to be in face-to-face relationship, the cut is configured to align with the notch, and at least a portion of the cut is configured for overlapping the notch when the blank is formed into the carton.

17. The blank of claim 16, wherein the second end flap is configured to overlap the first end flap when the blank is formed into the carton.

18. The blank of claim 16, wherein the first end flap is configured to overlap the second end flap when the blank is formed into the carton.

19. The blank of claim 16, wherein the cut is a v-shaped cut.

20. The blank of claim 16, wherein the fold line is a curved fold line.

21. The blank of claim 16, further comprising a third end flap foldably connected to the top panel and a third handle feature in the third end flap, the handle flap is a first handle flap, and the blank comprises a second handle flap foldably connected to the third end flap at a fold line, and the third handle feature comprises a cut extending from the fold line in the third end flap.

22. The blank of claim 21, wherein the third end flap is configured to be in face-to-face relationship with the second end flap when the blank is formed into the carton.

23. The blank of claim 22 wherein the third end flap is configured to overlap the second end flap and the first end flap is configured to overlap at least the third end flap so that at least the second end flap is adjacent an interior of the carton formed from the blank.

24. The blank of claim 22 wherein the first end flap, the second end flap, and the third end flap form a reinforced portion in the closed end that is above the handle of the carton formed from the blank.

25. The blank of claim 24, wherein the first handle feature, the second handle feature, and the third handle feature are configured to cooperate to direct tearing in the closed end in an upward direction from the handle towards the reinforced portion of the carton formed from the blank.

26. The blank of claim 16, wherein the top panel has a first lateral length and the bottom panel has a second lateral length, and the second lateral length is greater than the first lateral length.

27. The blank of claim 16, further comprises a dispenser in at least one of the top panel, the first side panel and the second side panel.

28. The blank of claim 27, wherein the dispenser comprises a first dispenser panel separable from the top panel and the first side panel along a first tear line, and a second dispenser panel separable from the top panel and the second side panel along a second tear line.

29. The blank of claim 28, wherein the dispenser comprises at least one finger tab along the first tear line in the first side panel and along the second tear line in the second side panel.

30. The blank of claim 16, further comprises a plurality of article protection flaps foldably connected to the bottom panel.

31. A method for forming a carton, the method comprising:

obtaining a blank comprising a plurality of panels, a first end flap foldably connected to a first panel of the plurality of panels, a second end flap foldably connected to a second panel of the plurality of panels, a first handle feature in the first end flap and a second handle feature in the second end flap, a handle flap foldably connected to the first end flap along a fold line, and a handle opening in the second end flap, wherein the first handle feature comprises a cut extending from the fold line in a direction away from the handle flap, the second handle feature comprises a notch adjacent the handle opening, the plurality of panels comprises a bottom panel, a first side panel foldably connected to the bottom panel, a second side panel foldably connected to the bottom panel, and a top panel foldably connected to at least one of the first side panel and the second side panel, the first panel comprises the bottom panel, and the second panel comprises one of the first side panel and the second side panel;

forming an interior of the carton at least partially defined by the plurality of panels;

inserting a plurality of articles into the interior of the carton;

at least partially overlapping the first end flap and the second end flap with respect to one another to at least partially form a closed end of the carton; and forming a handle in the closed end of the carton and positioning the first handle feature and the second handle feature to direct stress and to control tearing of the carton when force is applied to the handle, wherein the handle comprises the handle flap and the handle opening and forming the handle comprises positioning the first end flap and the second end flap in face-to-face relationship and aligning the cut with the notch so that at least a portion of the cut overlaps the notch.

32. The method of claim 31, wherein forming the handle comprises overlapping the second end flap and the first end flap.

33. The method of claim 31, wherein the cut is a v-shaped cut.

34. The method of claim 31, wherein the fold line is a curved fold line.

35. The method of claim 31, wherein the carton further comprises a third end flap foldably connected to the top panel and the handle comprises a third handle feature in the third end flap, the handle flap is a first handle flap, and the handle comprises a second handle flap foldably connected to the third end flap at a fold line, and the third handle feature comprises a cut extending from the fold line in the third end flap.

36. The method of claim 35, wherein forming the handle comprises positioning the third end flap in face-to-face relationship with the second end flap.

37. The method of claim 36 wherein forming the handle comprises overlapping the second end flap with the third end flap and overlapping the third end flap with the first end flap so that at least the second end flap is adjacent the interior of the carton.

38. The method of claim 36, further comprises forming a reinforced portion above the handle in the closed end with the first end flap, the second end flap, and the third end flap.

39. The method of claim 38, further comprises positioning the first handle feature, the second handle feature, and the third handle feature to direct tearing in the closed end in an upward direction from the handle towards the reinforced portion.

* * * * *